US007422833B2

(12) United States Patent
Niwa et al.

(10) Patent No.: US 7,422,833 B2
(45) Date of Patent: Sep. 9, 2008

(54) TONER, PRODUCTION PROCESS THEREOF, AND PROCESS FOR FORMING IMAGE

(75) Inventors: Kazu Niwa, Yokohama (JP); Fuminari Oyama, Yokohama (JP)

(73) Assignee: Zeon Corporation, Tokyo (JP)

( * ) Notice: Subject to any disclaimer, the term of this patent is extended or adjusted under 35 U.S.C. 154(b) by 757 days.

(21) Appl. No.: 10/380,761

(22) PCT Filed: Sep. 27, 2001

(86) PCT No.: PCT/JP01/08458

§ 371 (c)(1),
(2), (4) Date: Mar. 21, 2003

(87) PCT Pub. No.: WO02/29497

PCT Pub. Date: Apr. 11, 2002

(65) Prior Publication Data

US 2004/0013961 A1 Jan. 22, 2004

(30) Foreign Application Priority Data

Sep. 29, 2000 (JP) ..... 2000-298425
Sep. 29, 2000 (JP) ..... 2000-298426
Mar. 29, 2001 (JP) ..... 2001-094562

(51) Int. Cl.
*G03G 9/097* (2006.01)

(52) U.S. Cl. ..... 430/107.1; 430/108.5; 430/110.1; 430/111.41; 430/120.1

(58) Field of Classification Search ..... 430/107.1, 430/108.5, 110.1, 111.41, 120, 137.1, 137.17, 430/120.1
See application file for complete search history.

(56) References Cited

U.S. PATENT DOCUMENTS 4,621,039 A 11/1986 Ciccarelli et al. ..... 430/108.22
5,049,469 A * 9/1991 Pierce et al. ..... 430/110.2
5,529,871 A * 6/1996 Ichimura et al. ..... 430/110.1
5,723,250 A * 3/1998 Matsuoka et al. ..... 430/117
5,804,347 A * 9/1998 Inoue et al. ..... 430/108.1
5,840,462 A * 11/1998 Foucher et al. ..... 430/137.14
5,858,600 A * 1/1999 Itakura et al. ..... 430/137.1
5,925,488 A * 7/1999 Patel et al. ..... 430/137.14
6,054,245 A * 4/2000 Azuma et al. ..... 430/137.17
6,096,467 A * 8/2000 Shimizu et al. ..... 430/108.2
6,132,919 A * 10/2000 Ogawa et al. ..... 430/108.8
6,168,895 B1 * 1/2001 Metz et al. ..... 430/108.23
6,365,313 B1 * 4/2002 Masuo et al. ..... 430/108.22
6,562,535 B1 * 5/2003 Masuo et al. ..... 430/108.22
6,649,315 B1 * 11/2003 Takasaki ..... 430/110.3
2001/0023048 A1 * 9/2001 Shoji et al. ..... 430/110.3
2001/0033984 A1 * 10/2001 Matsumura et al. ..... 430/110.4
2003/0017406 A1 * 1/2003 Gutman et al. ..... 430/108.3

FOREIGN PATENT DOCUMENTS

EP 0 407 604 A 1/1991
EP 0 432 946 A 6/1991
EP 0 715 219 A 6/1996
EP 0 747 774 A 12/1996
JP 61-149969 7/1986
JP 61-172155 8/1986
JP 62-119549 5/1987
JP 63-60458 3/1988
JP 63-88564 4/1988
JP 1-217466 8/1989
JP 3-155568 7/1991
JP 4-242752 8/1992
JP 4-362656 12/1992
WO WO 99 59032 A 11/1999
WO WO 00 58790 A 10/2000

OTHER PUBLICATIONS

Database WPI, Section Ch, Week 199914 Derwent Publications Ltd., London, Great Britian Class A13, AN 1999-157909 XP 002194586/ Cited in the International Search Report.
Database WPI, Section Ch, Week 200001 Derwent Publications Ltd., London, Great Britian Class A89, AN 1999-6010717 XP 002194587/ Cited in the International Search Report.

* cited by examiner

*Primary Examiner*—John L Goodrow
(74) *Attorney, Agent, or Firm*—Westerman, Hattori, Daniels & Adrian, LLP.

(57) ABSTRACT

A charge control resin composition for positive or negative charge, which is prepared either by mixing and kneading a charge control resin for positive or negative charge with a colorant, or by mixing and kneading the above combination further with a charge control resin for opposite charge or a charge control resin composition for opposite charge; wherein colorant particles are finely dispersed as desired. The resultant mixture is mixed with a polymerizable monomer to obtain polymerizable monomer composition. Then, the polymerizable monomer composition is dispersed or emulsified in an aqueous dispersion medium containing a dispersion stabilizer, and polymerized to obtain a toner.

19 Claims, 1 Drawing Sheet

TONER, PRODUCTION PROCESS THEREOF, AND PROCESS FOR FORMING IMAGE

TECHNICAL FIELD

The present invention relates to, irrespective of one-component or two-components type, a toner for development of electrophotographic images which has excellent charge stability and transferability, and can provide images in clear color tones, a production process thereof, and process for forming images using said toner.

BACKGROUND ART

In an electrophotographic image forming process, visible images are formed is such a way that an electrostatic latent image member consisting of a photoconductive material is charged with electricity; an electrostatic latent image is formed on the charged electrostatic latent image member by exposure to a light pattern; a toner containing a colorant is applied on to the electrostatic latent image to form a toner image; the toner image is transferred to a transfer medium such as paper; and the transferred toner image is fixed to form a visible image.

As a toner for development of electrostatic images, a pulverized toner, a polymerized toner and others are known. A pulverized toner, which uses pulverized particles having sizes of about from 1 to 10 μm, is obtained by dispersing a colorant (such as carbon black, dye and pigment) in a binder resin (such as polystyrene) and pulverizing thus-obtained dispersed resin. To prepare a polymerized toner, a colorant is dispersed or dissolved in a polymerizable monomer to obtain a monomer composition, and the monomer composition is emulsified or suspended in an aqueous dispersion medium, polymerized, and agglomerated if necessary.

In an electrophotographic image forming process, use of a color process is becoming more popular and more advanced, and color toners which correspond to color-image forming apparatuses are increasingly demanded. It is known that a color-image forming apparatus is equipped with several image forming installments and each image forming installment forms a toner image in one color which is different in color from images formed by other installments. Toner images thus made in colors such as yellow, magenta, cyan and black are superimposed onto the single recording medium one by one.

Irrespective of a pulverized toner or a polymerized toner to be used, the following is required for a color toner:

(1) High transparency to enable superimposition of multiple colors.
(2) Excellent spectral reflection to enable reproduction of colors.
(3) Precise control of positive or negative charge level.
(4) Low fixing temperature.
(5) Easy manufacturing of color toners.

Conventionally, various techniques have been proposed to cope with above-described requirements. For example, Japanese Patent Application Laid-Open No. 1986-149969 has proposed that an additive for improving charge level, which is a polymer of amine group-containing monomer, is mixed with a pigment in halogenated hydrocarbon solvent such as chloroform using roll-mill. Then, the solvent is evaporated to form a pigment, to whose surface the additive for improving charge level is adhered. Thereafter, the pigment and resin particles are mixed by melting and pulverized to form a toner composition. Japanese Patent Application Laid-Open No. 1987-119549 has disclosed a toner production process in which a binder resin is dissolved in a solvent, and a colorant and a charge controlling agent are added thereto, and then they are mixed by agitation, thereafter the solvent is removed by freeze-drying. The resulting toner is pulverized and classified. Japanese Patent Application Laid-Open No. 1991-155568 has disclosed a toner production process in which a binder resin, at lease one of dye or pigment, and a solvent are mixed and mixed to form a masterbatch of the dye or pigment, and then the resulting masterbatch is further mixed with a binder resin and other additives if necessary; thereafter, they are pulverized and classified. Japanese Patent Application Laid-Open No. 1992-242752 has disclosed a color toner and a production process thereof, where a color toner is produced in a manner that a pigment dispersed in a binder resin, which is prepared by heating a pigment in a binder resin and mixing the mixture thereof, is further mixed with a binder resin; the resulting mixture are melted, mixed and classified to prepare a color toner; said color toner has at most 0.1% proportion of number of particles having at least 0.3 μm in diameter (presuming a circle for a particle) existing in a binder.

However, even with those proposals, it is extremely difficult to satisfy spontaneously various requirements for color toners as stated above. Particularly, it is difficult to prepare a color toner which has stable charge level and is excellent in transparency and spectral reflection properties.

SUMMARY OF THE INVENTION

It is an object of the present invention to provide a toner which is capable of providing a clear image in an electrophotographic image and little in variations of charge level by changes in environments, and a production process thereof, and further a process for forming images using said toner. In particular, for a color toner application, an object is to provide a toner which is excellent in spectral properties including high transparency needed for reproduction of a clear color tone in color images, generates a fog to a small extent, is capable of increasing print density, and is further excellent in printing durability, and a production process thereof, and further a process for forming images using said toner.

The present inventors have carried out an extensive investigation with a view toward overcoming the above-described problems involved in the prior art. As a result, it has been found that the above-described objects can be achieved by such a manner that a charge control resin composition for positive or negative charge, which is prepared by mixing a charge control resin for positive or negative charge with a colorant, is mixed with a charge control resin for opposite charge or a charge control resin composition for opposite charge, thereby colorant particles are finely dispersed as desired.

According to the present invention, there is thus provided a toner comprising a binder resin, a colorant and a charge control resin for positive and/or negative charge, wherein a number of colorant particles having a length of at least 0.2 μm counted in an area of 100 μm×100 μm of a toner having a thickness of 20 μm, which is prepared by melting the toner, being at most 50; and a production process thereof, and further a process for forming images using said toner.

Figure 1:
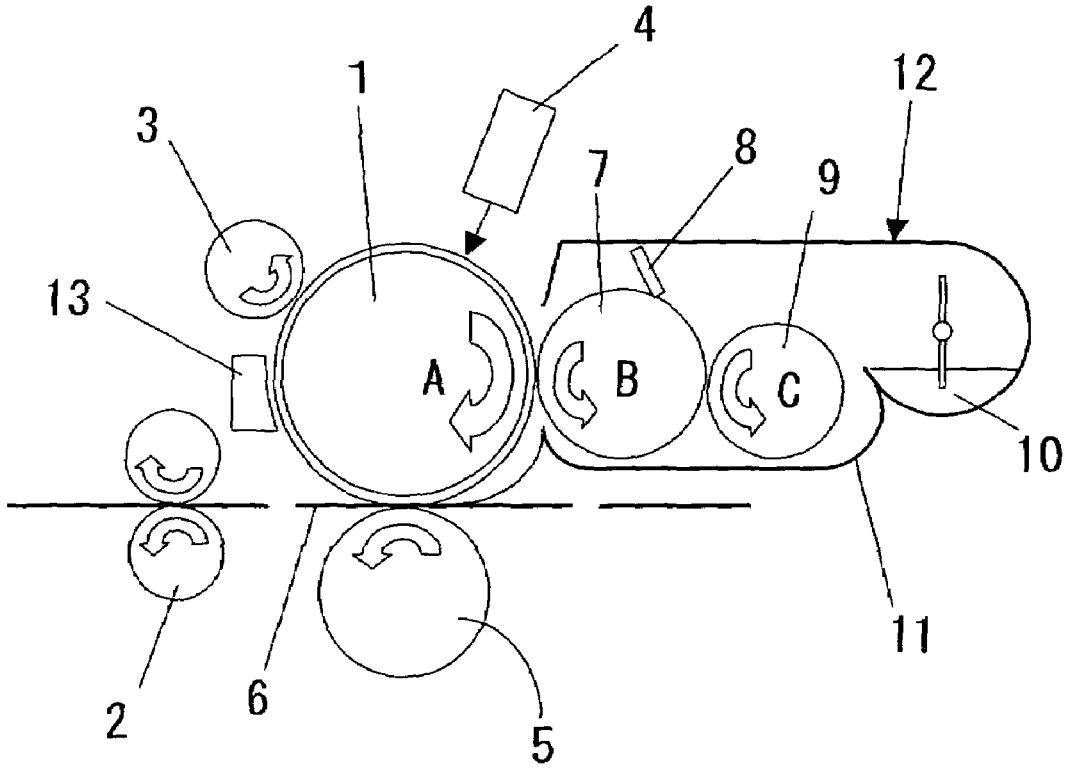
FIG. 1 An illustrative example of image forming apparatus used in the process for forming images of the present invention

| | |
|---|---|
| 1: | photosensitive drum |
| 3: | charge roll |
| 4: | laser-light irradiation equipment |
| 5: | transfer roll |
| 7: | developing roll |
| 8: | blade for developing roll |
| 9: | supply roll |
| 10: | toner |
| 11: | development equipment |
| 13: | cleaning equipment |

DESCRIPTION OF THE PREFERRED EMBODIMENT

The present invention will be described in detail.

A toner of the present invention comprises at least a binder resin, a colorant and a charge control resin for positive and/or negative charge.

As a binder resin, resins which are conventionally and widely used for toners can be used. For example, there can be mentioned polymers of styrene and its substituted derivatives such as polystyrene and polyvinyl toluene; styrene copolymers such as styrene-methylacrylate copolymer, styrene-ethylacrylate copolymer, styrene-butylacrylate copolymer, styrene-methylmethacrylate copolymer, styrene-ethylmethacrylate copolymer, styrene-butylmethacrylate copolymer, and styrene-maleate ester copolymer; polymethylmethacrylate, polyesters, polyamides, epoxy resins, polyvinyl butyral, rosins, modified rosins, terpene resins, phenol resins, aliphatic or alicyclic hydrocarbon resins, and aromatic petroleum resins. They may be used either singly or in any combination thereof.

As a colorant, there may be used any pigment and/or dye including carbon black, oil black, titanium black, and titanium white. Carbon black having a primary particle diameter from 20 to 40 nm is preferably used as a black colorant. If the particle diameter of the carbon black is smaller than 20 nm, dispersion of the carbon black is not attained, so that resulting toner sometimes becomes liable to generation of many fogs. In contrast, if the particle diameter is larger than 40 nm, the toner is sometimes liable to an environmental problem because polyaromatic hydrocarbons such as benzpyrene, which sometimes remains in the resulting toner, may be generated during a carbon black-production process.

For a full color toner, a yellow colorant, a magenta colorant and a cyan colorant are generally used.

As a yellow colorant, there may be used an azo pigment compound, a condensed polycyclic pigment compound and the like. Examples of the yellow colorant include pigments such as C.I. Pigment Yellow 3, 12, 13, 14, 15, 17, 62, 65, 73, 83, 90, 93, 97, 120, 138, 155, 180, and 181. Of these, Pigment Yellow 180 is preferred.

As a magenta colorant, there may be used an azo pigment compound, a condensed polycyclic pigment compound and the like. Examples of the magenta colorant include pigments such as C.I. Pigment Red 45, 57, 58, 60, 63, 64, 68, 81, 83, 87, 88, 89, 90, 112, 114, 122, 123, 144, 146, 149, 163, 170, 184, 185, 187, 202, 206, 207, 209, 251, and C.I. Pigment Violet 19. Of these, Pigment Red 122 and Pigment Red 184 are preferred.

As a cyan colorant, there may be used cupper phthalocyanine compound and its derivatives, anthraquinone compound and the like. Examples of the cyan colorant include pigments such as C.I. Pigment Blue 2, 3, 6, 15, 15:1, 15:2, 15:3, 15:4, 16, 17, and 60. Of these, Pigment Blue 15:3 and Pigment Blue 15:4 are preferred.

These colorants are used in an amount from 1 to 10 parts by weight per 100 parts by weight of a binder resin.

A charge control resin for negative charge is a resin which is negatively chargeable against toner supply rolls, developing rolls and thickness controlling-blades. As a charge control resin for positive charge, those disclosed in or those synthesized according to Japanese Patent Application Laid-Open Nos. 1988-88564, 1989-217466 and 1992-362656 can be used. As examples of such resin, there can be mentioned a resin having a substitution group in the side chain of the polymer, said substitution group is any one selected from (i) to (iv): (i) carboxylic group or carboxylate, (ii) phenol group or its salt, (iii) thiophenol group or its salt, and (iv) sulfonic acid or sulfonate. As examples of the salt to be formed from a substitution group contained in a polymer side chain, there can be mentioned a salt with metals such as zinc, magnesium, aluminum, sodium, calcium, chromium, iron, manganese, and cobalt, and a salt with organic bases such as ammonium ion, pyridinium ion, and imidazolium ion.

Of these, a resin whose polymer side-chain contains sulfonic acid or sulfonate is preferred, and a resin whose polymer main-chain is composed of monovinyl monomer unit and side-chain contains sulfonic acid or its salt is more preferred. Said resin is obtained by copolymerizing a sulfonic acid or its salt group-containing monovinyl monomer with other monovinyl monomer capable of copolymerizing therewith. Examples of the monomer capable of copolymerization include ethylenically unsaturated carboxylic acid ester monomers, aromatic vinyl monomers, and ethylenically unsaturated nitrile monomers.

As examples of the sulfonic acid or its salt group-containing monovinyl monomer, there can be mentioned styrene sulfonic acid, sodium styrene sulfonate, potassium styrene sulfonate, 2-acrylamide-2-methylpropane sulfonic acid, sodium vinyl sulfonate, and ammonium methallylsulfonate.

As examples of the ethylenically unsaturated carboxylic acid ester monomers, there can be mentioned, methyl (metha) acrylate, ethyl (metha)acrylate, propyl (metha)acrylate, butyl (metha)acrylate, and 2-ethyl hexyl (metha)acrylate.

As examples of the aromatic vinyl monomers, there can be mentioned styrene, methylstyrene, vinyltoluene, chlorostyrene, and hydroxymethylstyrene.

As examples of the ethylenically unsaturated nitrile monomers, there can be mentioned (metha)acrylonitrile, α-chloroacrylonitrile, and α-cyanoethylacrylonitrile.

The amount of the sulfonic acid or its salt group-containing monovinyl monomer unit in the charge control resin for negative charge used in the present invention is generally from 0.5 to 15% by weight, preferably from 1 to 10% by weight. If the amount of the monomer unit is too small, dispersion of the colorant becomes insufficient, resulting in reduced colorfulness and transparency in performance of the resulting toner; in contrast, if the amount is too large, charge level of the resulting toner is lowered at high temperature and high humidity, so that fogs may be generated in some cases.

The weight average molecular weight (Mw) of the charge control resin for negative charge is generally from 2,000 to 50,000, preferably from 4,000 to 40,000, more preferably from 6,000 to 30,000. If the weight average molecular weight of the charge control resin for negative charge is too low, dispersion of the colorant is insufficient because of low viscosity during mixing, resulting in reduced colorfulness and transparency in performance of the resulting toner; in contrast, if the weight average molecular weight is too high, dispersion of the colorant is insufficient because of high viscosity, resulting in reduced colorfulness and transparency in performance of the resulting toner.

The glass transition temperature of the charge control resin for negative charge is generally from 40 to 80° C., preferably from 45 to 75° C., more preferably from 45 to 70° C. If the glass transition temperature of the charge control resin for negative charge is too low, the shelf stability of the resulting toner becomes deteriorated; in contrast, if the glass transition temperature is too high, fixing ability of the resulting toner may be lowered in some cases.

A charge control resin for positive charge is a resin which is positively chargeable against toner supply rolls, developing rolls and thickness controlling-blades.

As a charge control resin for positive charge, those disclosed in and those synthesized according to Japanese Patent Application Laid-Open Nos. 1986-172155 and 1988-60458 can be used. As examples of such resin, there can be mentioned an amino group-containing resin, wherein the amino group includes —$NH_2$, —$NHCH_3$, —$N(CH_3)_2$, —$NHC_2H_5$, —$N(C_2H_5)_2$, —$NHC_2H_4OH$ and the like; and a functional group(ammonium salt group)-containing resin in which the amino groups are converted to ammonium salt groups.

The above-described resin is obtained by any one selected from (i) to (iii): (i) copolymerizing an amino group-containing monovinyl monomer with other monovinyl monomer capable of copolymerizing therewith, (ii) forming an ammonium salt of the copolymer obtained in (i), or (iii) copolymerizing an ammonium salt group-containing monovinyl monomer with other monovinyl monomer capable of copolymerizing therewith.

As examples of the amino-group containing monovinyl monomer, there can be mentioned (metha)acrylamide monomers such as (metha)acrylamide, N-methyl (metha)acrylamide, N,N-dimethyl (metha)acrylamide, and N-ethyl (metha) acrylamide; (metha)acrylic acid derivatives such as (metha) acrylic acid 3-(dimethyl amino) propyl; allyamine; styrene derivatives such as 2-aminostyrene, and 4-aminostyrene.

As an agent for forming an ammonium salt, there can be mentioned agents which are conventionally used for forming an ammonium salt which include halogenated alkyls such as methyl iodide, ethyl iodide, methyl bromide, and ethyl bromide; alkyl esters of para-toluene sulfonic acid such as methyl para-toluene sulfonate, ethyl para-toluene sulfonate, and propyl para-toluene sulfonate. The agent for forming an ammonium salt is generally added to the reaction solution after an amino-group containing monovinyl monomer is reacted with a monovinyl monomer capable of copolymerizing with said amino group containing monovinyl monomer The amount of the monovinyl monomer unit having functional group such as amino group, ammonium salt group, and the like in the charge control resin for positive charge used in the present invention is generally from 0.5 to 15% by weight, preferably from 1 to 10% by weight. If the amount of the monomer unit is too small, dispersion of the colorant sometimes becomes insufficient, resulting in reduced colorfulness and transparency in performance of the resulting toner; in contrast, if the amount is too large, charge level of the resulting toner is lowered at high temperature and high humidity, so that fogs may be generated in some cases.

The weight average molecular weight (Mw) of the charge control resin for positive charge is generally from 2,000 to 30,000, preferably from 4,000 to 25,000, more preferably from 6,000 to 20,000. If the weight average molecular weight of the charge control resin for positive charge is too low, dispersion of the colorant is sometimes insufficient because of low viscosity during mixing, resulting in reduced colorfulness and transparency in performance of the resulting toner; in contrast, if the weight average molecular weight is too high, dispersion of the colorant is sometimes insufficient because of high viscosity, resulting in reduced colorfulness and transparency in performance of the resulting toner.

The glass transition temperature of the charge control resin for positive charge is generally from 40 to 100° C., preferably from 45 to 80° C., more preferably from 45 to 70° C. If the glass transition temperature of the charge control resin for positive charge is too low, the shelf stability of the resulting toner sometimes becomes deteriorated; in contrast, if the glass transition temperature is too high, fixing ability of the resulting toner may be lowered in some cases.

These charge control resins for positive charge and for negative charge are preferably used in an amount of generally from 0.01 to 30 parts by weight of the total weight of both resins for positive and negative charge, preferably from 0.3 to 25 parts by weight, in most cases from 1 to 20 parts by weight per 100 parts by weight of the binder resin, so that desirable results can be obtained.

The toner of the present invention may contain parting agents and magnetic materials.

As examples of the parting agent, there can be mentioned low molecular weight polyolefin waxes such as low molecular weight polyethylene, low molecular weight polypropylene, and low molecular weight polybutylene; natural plant waxes such as candelilla, carnauba, rice, Japan wax, and jojoba; petroleum waxes such as paraffin, microcrystalline and petrolatum; mineral waxes such as montan, ceresin, and ozokerite; and synthetic waxes such as Fischer-Tropsch wax; polyfunctional ester compounds such as pentaerythritol tetramyristate, pentaerythritol tetrapalmitate, pentaerythritol tetrastearate, and dipentaerythritol hexamyristate. These parting agents may be used either singly or as a combination of two or more kinds.

Of these, synthetic waxes (Fischer-Tropsch wax in particular), terminal-modified polyolefin waxes, petroleum waxes, and polyfunctional ester compounds are preferable. Among the polyfunctional ester compounds, polyfunctional pentaerythritol esters which show endothermic peak temperature upon heating within a range of 30° C. to 200° C., preferably 40° C. to 160° C. and more preferably 50° C. to 120° C. on a DSC curve determined by means of a differential scanning calorimeter (DSC) and polyfunctional dipentaerythritol esters which show endothermic peak temperature within a range of 50° C. to 80° C. are particularly preferable as a toner from a view point of a balance between fixing and offset properties. Of these, a polyfunctional ester compound, which has a molecular weight of at least 1000, is capable of being dissolved in styrene at 25° C. in a proportion of at least 5 parts by weight based on 100 parts by weight of styrene, and has an acid value of at most 10 mg/KOH, is particularly preferred because it exhibits a distinguished effect in lowering a fixing temperature. The above-described endothermic peak temperatures are measured in accordance with ASTM D3418-82.

The above-described parting agents are preferably used in an amount of generally from 0.5 to 50 parts by weight, preferably from 1 to 20 parts by weight per 100 parts by weight of the binder resin.

As examples of the magnetic material, there can be mentioned iron oxides such as magnetite, gamma-iron oxide, and ferrite; metals such as iron, cobalt, and nickel.

In the toner according to the present invention, numbers of colorant particles having a length of at least 0.2 μm counted in an area of 100 μm×100 μm of a toner, which is prepared by heat-melting and has a thickness of 20 μm, are at most 50, preferably at most 30, and more preferably at most 20. If the number is too large, spectral properties including transparency which is necessary for reproduction of a color tone of a color image sometimes becomes poor, fogs may be generated in some cases, and printing density sometimes becomes low. Spectral properties are measured by a spectral color-difference meter, where the color tone of the directly printed samples of each color printed by a commercially available printer are measured.

The volume average particle diameter (dv) of the toner according to the present invention is not particularly limited, but preferably from 2 to 10 μm, more preferably from 2 to 9 μm, and most preferably from 3 to 8 μm. And, the ratio of a volume average particle diameter (dv) to a number average particle diameter (dp) is not particularly limited, but, preferably at most 1.7, more preferably at most 1.5, and most preferably at most 1.3.

The toner according to the present invention has a ratio (rl/rs) of a length (rl) to a breadth (rs) thereof of generally in the range from 1 to 1.2, preferably from 1 to 1.1. If the ratio is too high, transferability of toner images recorded on photosensitive member to a transfer medium such as paper is reduced, and friction among toner particles when the toner is stored in a toner container in a image forming apparatus becomes high, resulting in peeling-off of outer additives, so that the durability of the resulting toner tends to be deteriorated.

The negatively charged toner according to the present invention has a blow-off charge level against iron powder of preferably from minus 40 to minus 120 μC/g, more preferably from minus 60 to minus 100 μC/g. If the charge level is lower than minus 40 μC/g, fogs may be generated in some cases; in contrast, if it is higher than minus 120 μC/g, flowability of the resulting toner sometimes tends to be reduced, resulting in generation of dimming. The positively charged toner according to the present invention has a blow-off charge level against iron powder of preferably from plus 20 to plus 100 μC/g, more preferably from plus 40 to plus 80 μC/g. If the charge level is lower than plus 20 μC/g, fogs may be generated in some cases; in contrast, if it is higher than plus 100 μC/g, flowability of the resulting toner sometimes tends to be reduced, resulting in generation of dimming.

Meanwhile, whether a toner becomes negatively charged or positively charged depends on a ratio of molar equivalent of a charge control resin for negative charge versus that of for positive charge. To obtain a negatively charged toner, it is necessary either to use only a charge control resin for negative charge, or to control the content of each charge control resin contained in a toner in such manner that the number of molar equivalent of functional groups (for example, sulfonic acid group), which lead to negative charge, contained in a charge control resin for negative charge (including those contained in a charge control composition) is more than the number of molar equivalent of functional groups (for example, quaternary ammonium salt group), which lead to positive charge, contained in a charge control resin for positive charge (including those contained in a charge control composition). To obtain a positively charged toner, it is necessary either to use only a charge control resin for positive charge, or to control the content of each charge control resin contained in a toner in such manner that the number of molar equivalent of functional groups, which lead to positive charge, contained in a charge control resin for positive charge (including those contained in a charge control composition) is more than the number of molar equivalent of functional groups, which lead to negative charge, contained in a charge control resin for negative charge (including those contained in a charge control composition).

The toner according to the present invention has an insoluble proportion in tetrahydrofuran (hereinafter sometimes referred to "gel content") of generally at most 80% by weight, preferably at most 60% by weight, and more preferably at most 40% by weight. If the tetrahydrofuran-insoluble portion is too high, the fixing property and transparency of the resulting toner may be reduced.

The toner according to the present invention has a volume resistivity (log (Ω·cm)) measured by dielectric loss meter of preferably from 10 to 13, and more preferably from 10.5 to 12.5. If the volume resistivity is too low, fogs may be generated in some cases; in contrast, if the volume resistivity is too high, cleaning of equipments sometimes becomes insufficient.

The toner to be used in the present invention may optionally be a so-called core-shell type particle (also called capsule type) in which inner part of a particle (core) and outer part of the particle (shell) are composed of different polymers. The core-shell structure is preferred, because the structure can provide a favorable balance between lowering the fixing temperature and shelf stability by making use of a method of covering the inner part having a low softening point (core) by a material having a high softening point (shell). As a process for producing the core-shell type toner, there may be used methods such as spray-dry method, surface-reaction method, in-situ method and phase-separation method. Of these, in-situ method and phase-separation method are preferable because of their efficient productivity. Further, a core particle in the core-shell type toner may be any one of a particle obtained by pulverizing process, polymerization process, agglomeration process or phase-transfer emulsion process.

The glass transition temperature (Tg) of the polymer constituting the core layer of the core-shell type toner is generally from 0 to 80° C., preferably from 40 to 60° C. If the glass transition temperature (Tg) is too high, the fixing temperature of the resulting toner may become high; in contrast, if it is too low, the shelf stability of the resulting toner may be reduced.

The glass transition temperature (Tg) of the polymer constituting the shell layer of the core-shell type toner must be preset being higher than the glass transition temperature of the polymer constituting the core. In order to improve the shelf stability of the polymerized toner, the glass transition temperature of the polymer constituting the shell layer is generally from 50 to 130° C., preferably from 60 to 120° C., and more preferably from 80 to 110° C. If the glass transition temperature (Tg) is lower that the above, the shelf stability of the resulting toner may reduced; in contrast, if it is higher, the fixing property of the resulting toner may be lowered.

A difference in glass transition temperature between the polymer constituting the core and the polymer constituting the shell layer is generally at least 10° C., preferably at least 20° C., and more preferably at least 30° C. If the difference is smaller than the above, a balance between shelf stability and fixing property tends to be deteriorated.

The volume average particle diameter (dv) of the core-shell type toner is not particularly limited, but generally from 2 to 10 μm, preferably from 2 to 9 μm, and more preferably from 3 to 8 μm. And, the ratio of a volume average particle diameter (dv) to a number average particle diameter (dp) is not particularly limited, but, generally at most 1.7, preferably at most 1.5, and more preferably at most 1.3.

The proportion by weight of the core layer to shell layer of the core-shell type toner is not particularly limited, but generally in the range from 80/20 to 99.9/0.1. If the proportion of the shall layer is lower than the above, shelf stability of the resulting toner may be reduced in some cases; in contrast, if it is higher than the above proportion, fixing of the resulting toner at low temperature sometimes becomes difficult.

The average thickness of the shell layer of the core-shell type toner is generally from 0.001 to 1 μm, preferably from 0.003 to 0.5 μm, and more preferably from 0.005 to 0.2 μm. If the thickness is too large, fixing property of the resulting toner may be reduced in some cases; in contrast, if it is too small, shelf stability of the resulting toner may be reduced in some cases. The core particle constituting the core-shell type toner is not necessarily covered all of its surface by the shell layer.

The diameter of the core particle and the thickness of the shell layer of the core-shell type toner can be measured by measuring directly the size and thickness of shell layer of particles which are chosen randomly from photographs observed by an electron microscope, and when it is difficult to observe both of the core and shell layer by an electron microscope, they can be calculated based on the diameter of the core particle and the quantity of the monomer used for forming the shell layer at the time of preparing colored particles.

In the toner according to the present invention, it is preferable that outer additives are adhered to the surface of the toner particles or partly embedded in the toner. Examples of the outer additives include inorganic particles and organic resin particles, preferably a combination of inorganic particles and organic resin particles. Examples of the inorganic particles include particles of silica, titanium oxide, with the inorganic oxides subjected to a hydrophobicity-imparting treatment being particularly preferred. The amount of the outer-additives is not particularly limited, but is generally from 0.1 to 6 parts by weight per 100 parts by weight of the toner particles. In order to make the outer additives adhered to the toner particles, the outer additives and the above-described polymer particle are generally poured into a mixer such as Henschel-mixer to mix them under stirring.

The toner of this invention is not limited by the production process thereof. As examples, there may be mentioned (I) a pulverizing process in which a charge control resin composition for negative and/or positive charge and a parting agent are heat-fused, mixed and uniformly dispersed into a thermoplastic resin which is used as a binder resin to form a resin composition; and then the resin composition is pulverized and classified to produce a toner, (II) a polymerization process in which a charge control resin composition for negative and/or positive charge and a parting agent are solubilized or dispersed in a polymerizable monomer (a raw material for a binder resin); and then, after addition of a polymerization initiator, they are suspended or emulsified in aqueous dispersion medium containing a dispersion stabilizer, heated to a desired temperature, and polymerized; thereafter, after polymerization is stopped, they are filtered, rinsed, dehydrated and dried to obtain a toner, (III) an agglomeration process in which a binder resin particle obtained by emulsion or suspension polymerization and a particle containing a charge control resin composition for negative and/or positive charge are agglomerated to form agglomerated particles, and then the agglomerated particles are filtered and dried to obtain a toner, and (IV) phase-transfer emulsion process in which a charge control resin composition for negative and/or positive charge are mixed with a resin having a hydrophilic group which is used as a binder resin, and the mixture is solubilized in an organic solvent; then the hydrophilic group of the resin is neutralized, thereby phase-transfer is taking place; thereafter they are dried to obtain a toner. It is preferred to use a toner obtained by the polymerization process in view of obtaining a toner having good dot-reproducibility.

In the toner production process according to the present invention, one of the following (i) to (v) is contained in the binder resin; (i) only a charge control resin composition for negative charge, (ii) only a charge control resin composition for positive charge, (iii) a combination of a charge control resin composition for negative charge with a charge control resin for positive charge, (iv) a combination of a charge control resin composition for positive charge with a charge control resin for negative charge, and (v) a combination of a charge control resin composition for negative charge with a charge control resin composition for positive charge. Of these, (v), a combination of a charge control resin composition for negative charge with a charge control resin composition for positive charge is particularly preferred in view of easy control of a charge level of the resulting toner.

The charge control resin composition for negative or positive charge according to the present invention is obtained by combining the charge control resin for negative or positive charge with the colorant respectively. An amount of the colorant to be used is generally from 10 to 200 parts by weight, preferably from 20 to 150 parts by weight per 100 parts by weight of the charge control resin.

For production of the charge control resin composition for negative or positive charge used in the present invention, an organic solvent may be used as required. When an organic solvent is used, the charge control resin for negative or positive charge can be mixed after dissolving or swelling thereof in the organic solvent; on the other hand, when an organic solvent is not used, it is necessary to warm up the resin to a temperature at which the resin is softened and then mixed. When an organic solvent is used, mixing is preferably conducted at room temperature or under chilling, because the organic solvent sometimes evaporates when heated, especially if the boiling point of the solvent is low. Moreover, if the organic solvent remains in the toner, a problem of bad odor arises, so that it is preferable to eliminate the organic solvent at production process of either the toner or the charge control resin composition.

The organic solvent is used in an amount of from 0 to 100 parts by weight, preferably from 5 to 80 parts by weight, and more preferably from 10 to 60 parts by weight per 100 parts by weight of the charge control resin. Within this range, an excellent balance between dispersibility and processibility is obtained. The organic solvent may be added either at one time or dividedly upon observing the mixing operation.

When an organic solvent is used, the solubility parameter (hereinafter referred to as "SP") of the organic solvent is preferably in the range from 8 to 15 $(cal/cm^3)^{1/2}$ and the boiling point of the organic solvent is preferably in the range from 50 to 150° C. If the SP is less than 8 $(cal/cm^3)^{1/2}$, the charge control resin may not be solubilized because of low polarity in some cases; in contrast, if the SP is more than 15 $(cal/cm^3)^{1/2}$, the charge control resin may not be solubilized because of high polarity in some cases. On the other hand, if the boiling point is lower than 50° C., the solvent sometimes evaporates because of the heat generated by mixing; in contrast, if the boiling point is higher than 150° C., removal of solvent after mixing sometimes becomes difficult.

As specific examples of the solvent (SP/boiling point), there can be mentioned methanol(14.5/65° C.), ethanol(10.0/78.3° C.), propanol(11.9/97.2° C.), diethyl ketone(8.8/102° C.), di-n-propyl ketone(8.0/144° C.), di-iso-propyl ketone (8.0/124° C.), methyl-n-propyl ketone(8.3/102° C.), methyl-iso-propyl ketone(8.5/95° C.), methyl-n-butyl ketone(8.5/127° C.), methyl-iso-butyl ketone(8.4/117° C.), toluene(8.9/110° C.), tetrahydrofuran(9.1/65° C.), methyl ethyl ketone (9.3/80° C.), acetone(9.9/56° C.), and cyclohexane(9.9/156° C.). These solvents may be used either singly or in any combination thereof. Of these, diethyl ketone, methyl-n-propyl ketone, methyl-n-butyl ketone, toluene/methanol mixed solvent, toluene/ethanol mixed solvent, and toluene/propanol mixed solvent are preferably used in view of solubility to a charge control resin and easiness of being removed after mixing.

A charge control resin and a colorant may be mixed to obtain a charge control resin composition by using equipment such as a roll, plasticorder (manufactured by Brabender Co.), labo-plastomill (manufactured by Toyo Seiki Co.), a kneader, a single screw extruder, a twin screw extruder, banbury, buss-kneader, and the like. When an organic solvent is used, in view of avoiding the bad odor and toxicity problems, it is preferable to use the mixing equipment in a closed system which prevents leakage of the solvent. Moreover, it is preferable to use the mixing equipment equipped with a torque meter, because the torque meter enables to control the dispersibility by observing the torque.

The charge control resin composition for negative or positive charge used in the present invention is preferably in a state such that: 5% solution of the charge control resin composition is prepared by adding a solvent to the composition, thereafter, the solution is coated and dried to form a film of 30 μm in thickness, thereby the number of colorant particles having a length of at least 0.2 μm counted in an area of 100 μm×100 μm of the film is preferably at most 20, more preferably at most 10, and most preferably at most 5. If the number is too large, spectral properties including transparency which are necessary for reproduction of a color tone of color images becomes poor, fogs may be generated in some cases, and printing density sometimes becomes low. Spectral properties are measured by spectral color-difference meter, where the color tone of the directly printed samples of each color printed by a commercially available printer are measured.

In the toner production process according to the present invention, to obtain a negatively charged toner, it is necessary either to use only a charge control resin for negative charge, or to control the ratio of the combination of each charge control resin contained in a toner in such a manner that the number of molar equivalent of functional groups (for example, sulfonic acid group), which lead to negative charge, contained in a charge control resin for negative charge (including those contained in a charge control composition) is more than the number of molar equivalent of functional groups (for example, quaternary ammonium salt group), which lead to positive charge, contained in a charge control resin for positive charge. The same applies to obtain a positively charged toner, except that the charges to be used must be the opposite ones.

On a industrial scale, to obtain a toner using both of the charge control resin for negative charge and the charge control resin for positive charge, it is preferable to use a method in which ratio of molar equivalents of functional groups is controlled between the charge control resins for negative and positive charge.

To obtain a negatively charged toner using both of the charge control resin for negative charge and the charge control resin for positive charge, it is preferable to preset the ratio of molar equivalent of functional group for negative charge versus molar equivalent of functional group for positive charge at generally in the range from 1:0.005 to 1:0.9, preferably from 1:0.01 to 1:0.8, and more preferably from 1:0.05 to 1:0.7. To obtain a positively charged toner, it is preferable to preset the ratio at the reversed ratio of the above-described ratio. If these ratios are too small, charge control ability during continuous printing sometimes becomes insufficient, resulting in undesirable results such as reduced printing durability, reduced printing density and generation of fogs; in contrast, if these ratios are too large, charge levels sometimes become insufficient, and fogs may be generated in some cases.

In the present invention, the toner can be obtained which has a sharp particle size distribution, an excellent balance between flowability and shelf stability, little in variations of charge levels in both high temperature/high humidity and low temperature/low humidity environments, and is able to suppress generation of fogs and deterioration of image qualities under continuous printing. Said toner is prepared by using both of the charge control resin for negative charge and the charge control resin for positive charge, and preferably by using them at the above-described ratio of molar equivalent of functional groups between negative charge and positive charge.

The charge control resins for positive charge and for negative charge are preferably used in an amount of generally from 0.01 to 30 parts by weight of the total weight of both resins for positive and negative charge, preferably from 0.3 to 25 parts by weight, in most cases from 1 to 20 parts by weight per 100 parts by weight of the binder resin or per 100 parts by weight of the polymerizable monomer to be used to obtain the binder resin, so that desirable results can be obtained.

As a process to incorporate into a toner the charge control resin for negative charge and/or the charge control resin for positive charge, there may be mentioned a pulverizing process and a polymerization process. In the pulverizing process, binder resin, one of those above-described (i)-(v) as a charge control resin composition and other additives if necessary are heat-melted and mixed; and then, after being chilled, they are pulverized and classified to produce a toner having a desired particle size distribution. In the polymerization process, a polymerizable monomer composition is polymerized, wherein said composition contains a polymerizable monomer (raw material for a binder resin), one of those above-described (i)-(v) as a charge control resin composition and other additives if necessary.

In the polymerization process, polymerization of polymerizable monomers can be carried out by one of emulsion polymerization, suspension polymerization, phase-separation polymerization or soap-free polymerization. Of these, suspension polymerization is preferred in view of improving charge level and excellent transferability of the resulting toner caused by uniform distribution of colorants.

As a polymerizable monomer to obtain the binder resin, there can be mentioned monovinyl-type monomers, crosslinkable monomers, and macromonomers. These polymerizable monomers are polymerized to form a binder resin component in a polymer particle.

Specific examples of the monovinyl monomer include aromatic vinyl monomers such as styrene, vinyltoluene, and α-methylstyrene; (metha)acrylic acid; derivatives of (metha) acrylic acid, such as methyl (metha)acrylate, ethyl (metha) acrylate, propyl (metha)acrylate, butyl (metha)acrylate, 2-ethylhexyl (metha)acrylate, cyclo-hexyl (metha)acrylate, iso-bornyl (metha)acrylate, dimethylaminoethyl (metha) acrylate, and (metha)acrylamide; mono-olefinic monomers such as ethylene, propylene, and butylenes. These monovinyl monomers may be used either singly or in any combination thereof. Among these monovinyl monomers, the aromatic vinyl monomer alone or a combination of aromatic vinyl monomers with derivatives of (metha)acrylic acid is preferably used.

It is preferred, from the viewpoints of improving the hot offset resistance, to use crosslinkable monomers and polymers in combination with the monovinyl monomer. The crosslinkable monomer is a monomer having two or more polymerizable carbon-carbon unsaturated double bonds. As examples of the crosslinkable monomer, there may be mentioned aromatic divinyl compounds such as divinylbenzene, divinylnaphthalene and derivatives thereof; di-ethylenically unsaturated carboxylic acid esters such as ethylene glycol dimethacrylate, and diethylene glycol dimethacrylate; compounds having two vinyl groups such as N,N-divinylaniline and divinyl ether; and compounds having three or more vinyl groups such as pentaerythritol-tri-allyl ether, and tri-methylol propane-tri-acrylate. The crosslinkable polymer is a polymer having two or more vinyl groups in the polymer. As examples of the crosslinkable polymer, there may be mentioned esters obtained by condensation reaction of polymers which have two or more hydroxyl group in the polymer structure such as polyethylene, polypropylene, polyesters, and polyethylene glycol, with unsaturated carboxylic acid monomers such as acrylic acid and methacrylic acid. These crosslinkable monomers and polymers may be used either singly or in any combination thereof. It is desirable to use in an amount of generally at most 10 parts by weight, preferably from 0.1 to 2 parts by weight per 100 parts by weight of the monovinyl monomer.

It is preferred, from the viewpoints of improving a balance between shelf stability at high temperature and fixing ability at low temperature, to use a macromonomer together with a monovinyl monomer. The macromonomer is an oligomer or polymer having a polymerizable vinyl functional group at its molecular chain terminal and a number average molecular weight of generally from 1,000 to 30,000. If the number average molecular weight is too low, surface of polymer particle tends to be softened, resulting in a lowered shelf stability of the resulting toner; in contrast, if the number average molecular weight is too high, melting of the macromonomer may become difficult, so that fixing ability and shelf stability of the resulting toner tend to be reduced.

Examples of the polymerizable vinyl functional groups bonded to the molecular chain terminal of the macromonomer include an acryloyl group and a methacryloyl group, with the methacryloyl group being preferred from the viewpoint of easiness of copolymerization.

The macromonomer used in the present invention is preferably such that can give a polymer having a glass transition temperature (Tg) higher than that of a polymer obtained by polymerizing a monovinyl monomer. As examples of the macromonomer, there may be mentioned polymers obtained by polymerizing styrene, styrene derivatives, methacrylic esters, acrylic esters, acrylonitrile, and methacrylonitrile either singly or in combination of two or more monomers thereof; and macromonomers having a polysiloxane skeleton. Among these macromonomers, hydrophilic macromonomers which are obtained by polymerizing methacrylic esters or acrylic esters either singly or in combination of two or more monomers thereof are particularly preferred.

The amount of the macromonomer is generally from 0.01 to 10 parts by weight, preferably from 0.03 to 5 parts by weight, more preferably from 0.05 to 1 part by weight per 100 parts by weight of the monovinyl monomer. If the amount of the macromonomer is too low, the effect of improving the shelf stability of the resulting toner becomes little; in contrast, if the amount of the macromonomer is extremely high, fixing ability of the resulting toner tends to be deteriorated.

As examples of the dispersion stabilizer, there may be mentioned sulfates such as barium sulfate and calcium sulfate; carbonates such as barium carbonate, calcium carbonate, and magnesium carbonate; phosphates such as calcium phosphate; metal oxides such as aluminum oxide and titanium oxide; and metal hydroxides such as aluminum hydroxide, magnesium hydroxide, and ferric hydroxide; water soluble polymer such as polyvinyl alcohol, methyl cellulose, and gelatin; anionic surface active agent, nonionic surface active agent and amphoteric surface active agent. They may be used either singly or in combination of two or more thereof. Among these, the use of the metal-compound or the dispersion stabilizer containing colloid of the hardly water-soluble metal hydroxide in particular is preferred because that the particle diameter distributions of the resulting polymer particles can be narrowed and residuals of a dispersion stabilizer after rinsing are small, so that bright or sharp images can be reproduced.

The production process of the dispersing agent containing the colloid of the hardly water-soluble metal hydroxide is not particularly limited. However, it is preferred to use colloid of a hardly water-soluble metal hydroxide obtained by adjusting the pH of an aqueous solution of a water-soluble polyvalent metallic compound to 7 or higher, with colloid of a hardly water-soluble metal hydroxide formed by reacting a water-soluble polyvalent metallic compound with an alkali metal hydroxide in an aqueous phase being particularly preferred.

The colloid of the hardly water-soluble metal hydroxide used in the present invention preferably has number particle diameter distributions, $D_{50}$ (50% cumulative value of number particle diameter distribution) of at most 0.5 μm and $D_{90}$ (90% cumulative value of number particle diameter distribution) of at most 1 μm. if the particle diameter of the colloid is too large, the stability of the polymerization is broken, and the shelf stability of the resulting polymerized toner is deteriorated.

The dispersing agent is generally used in an amount from 0.1 to 20 parts by weight per 100 parts by weight of the polymerizable monomer. If the amount of the dispersing agent used is lower than 0.1 parts by weight, it is difficult to achieve sufficient polymerization stability, so that the resulting polymer tends to aggregate. On the other hand, if the amount of the dispersing agent used exceeds 20 parts by weight, particle sizes of toners after polymerization becomes too small, so that resulting toners are not usable.

As examples of the polymerization initiator, there may be mentioned persulfates such as potassium persulfate and ammonium persulfate; azo compounds such as 4,4'-azobis-(4-cyanovaleric acid), 2,2'-azobis-(2-methyl-N-(2-hydroxyethyl) propionamide, 2,2'-azobis(2-amidinopropane) bihydrochloride, 2,2'-azobis(2,4-dimethyl valeronitrile), and 2,2'-azobis-isobutyronitrile; and peroxides such as di-t-butyl peroxide, dicumyl peroxide, lauroyl peroxide, benzoyl peroxide, t-butyl peroxy-2-ethylhexanoate, t-hexyl peroxy-2-ethylhexanoate, t-butyl peroxy-pivalate, di-isopropyl peroxydicarbonate, di-t-butyl peroxyisophthalate, 1,1',3,3'-tetramethylbutyl peroxy-2-ethylhexanoate, and t-butyl peroxyisobutyrate. Redox initiators composed of combinations of these polymerization initiators with reducing agents may also be mentioned.

Of these polymerization initiators, oil-soluble polymerization initiators which are soluble in polymerizable monomers are preferable selected. Optionally, a water-soluble polymerization initiator can be used in combination with oil-soluble polymerization initiators. The amount of the above-described polymerization initiators are used in the range from 0.1 to 20 parts by weight, preferably from 0.3 to 15 parts by weight, and more preferably from 0.5 to 10 parts by weight per 100 parts by weight of the polymerizable monomer.

The polymerization initiator may optionally be added to suspension solution after the granulating (particle formation) step is completed, in the case of suspension polymerization;

or may optionally be added to emulsion solution after the emulsifying step is completed, in the case of emulsion polymerization. It is preferable that the initiator is added to the polymerizable monomer compositions in advance.

A molecular weight modifier is preferably added to the polymerization system. As examples of the molecular weight modifier, there may be mentioned mercaptans such as t-dodecyl-mercaptan, n-dodecylmercaptan, n-octylmercaptan, and 2,2,4,6,6-pentamethylheptane-4-thiol; and halogenated hydrocarbons such as carbon tetrachloride and carbon tetrabromide. These molecular weight modifiers may be added before the initiation of the polymerization or during the course of the polymerization. The molecular weight modifier is used in an amount of generally from 0.01 to 10 parts by weight, preferably from 0.1 to 5 parts by weight per 100 parts by weight of the polymerizable monomer.

In a suspension polymerization process which is a preferred production process in the present invention, a polymerizable monomer composition is dispersed in an aqueous medium containing a dispersion stabilizer, and then is polymerized using a polymerization initiator; wherein said polymerizable monomer composition comprises a polymerizable monomer, a charge control resin composition for negative charge or a charge control resin for negative charge (as one party) and a charge control resin composition for positive charge or a charge control resin for positive charge (as the other party) (however, at least one party must use a charge control resin composition), and other additives. As the other additives, there may be mentioned above-described parting agent, magnetic material and molecular weight modifier.

As a toner in the present invention, the toner prepared by the above-described method or a core-shell type toner may be used. As a process for producing a shell layer, there may be used methods such as spray-dry method, surface-reaction method, in-situ method and phase-separation method. A core-shell type toner can be produced by covering a core particle by a shell layer, wherein the core particle may be a toner obtained by pulverizing process, polymerization process, agglomeration process or phase-transfer emulsion process. Of these, in-situ method and phase-separation method are preferable because of their efficient productivity.

Hereafter, a process for producing a core-shell type toner using in-situ polymerization process is explained.

A polymerizable monomer to form a shell (polymerizable monomer for shell) and a polymerization initiator are added to an aqueous dispersion medium in which core particles are dispersed, and then polymerized to obtain the core-shell type toner.

As specific examples of the process to form a shell, there may be a process in which a polymerizable monomer for shell is added to the above-mentioned polymerization system for core and polymerized in-situ; or a process in which a core particle prepared in a separate polymerization system is poured into the reaction system and a polymerizable monomer for shell is added and then polymerized.

The polymerizable monomer for shell may be charged to a reaction system at one time, or may be charged continuously or dividedly using a plunger pump.

As the monomer for shell, monomers capable of forming a polymer having a Tg of higher than 80° C., such as styrene, acrylonitrile and methyl methacrylate, are generally used either singly or in combination of two or more monomers thereof.

When the monomer for shell is added to the reaction system, water-soluble radical-initiator is preferably added spontaneously with the addition of the monomer for shell to easily obtain the core-shell type toner. It is estimated that, in doing the above, the water-soluble radical-initiator migrates to a zone surrounding the surface of the core particle, so that a polymer (shell layer) is easily formed on the surface of the core.

As water-soluble radical-polymerization initiators, there can be mentioned persulfates such as potassium persulfate, and ammonium persulfate; azo compounds such as 4,4'-azobis(4-cyanovaleric acid), 2,2'-azobis(2-amidinopropane) bihydrochloride, 2,2'-azobis-2-methyl-N-1,1'-bis(hydroxymethyl)-2-hydroxyethyl propionamide, 2,2'-azobis(2,4-dimethylvaleronitrile), and 2,2'-azobisisobutyronitrile; combinations of an oil-soluble initiator such as cumene peroxide with a redox catalyst. The water-soluble radical-polymerization initiators can be used in an amount of generally from 0.1 part to 20 parts by weight 100 parts by weight of the monomer for shell. If the amount of the initiators is too small, the rate of polymerization becomes low, resulting in a reduced productivity; in contrast, if the amount is too large, the molecular weight of the resulting polymer may be reduced in some cases, resulting in deteriorated shelf stability.

The toner obtained by the production process according to the present invention is a minute particle in substantially spherical shape having a volume average particle diameter (dv) from 2 to 10 μm, preferably from 3 to 8 μm, and the sharp particle diameter distribution, i.e., a ratio of a volume average particle diameter (dv) to a number average particle diameter (dp), of at most 1.7, preferably at most 1.5, more preferably at most 1.3. If the volume average particle diameter of the toner is too large, the resolution of images formed with such a toner may be lowered in some cases. If the particle diameter distribution is too large, proportion of coarse particles may increase, so that the resolution of images formed with such a toner may be lowered in some cases.

The toner according to the present invention has a ratio (rl/rs) of a length (rl) to a breadth (rs) thereof of generally in the range from 1 to 1.2, preferably from 1 to 1.1. If the ratio is too high, the transferability of toner images recorded on photosensitive member to a transfer medium such as paper may be reduced in some cases, and friction between toner particles when the toner is stored in a toner container in a image forming apparatus may become high, resulting in peeling off of outer additives, so that the durability of the toner may be deteriorated in some cases.

In the electrophotographic image forming process according to the present invention, visible images are formed in such a way that the above-described toner is adhered to the surface of a photosensitive member, on which an electrostatic latent image was recorded, to obtain a visible image, and then thus-obtained visible image is transferred to transfer medium.

Hereafter, an image forming process is explained in detail with reference to FIG. 1. Although the following explanation relates to non-magnetic one-component developing type, the electrophotographic image forming process according to the present invention is not limited hereto; the process may apply also to magnetic one-component developing type, non-magnetic two-components developing type, and magnetic two-components developing type. As is shown in FIG. 1, an image forming apparatus is equipped with the photosensitive drum 1 which functions as a photosensitive member and is able to rotate freely to the direction of the arrow A. The photosensitive drum 1 has a structure that photoconductive layer is placed on the outer surface of a supporting member. The photoconductive layer is composed of, for example, organic photo-sensitive material, selenium photo-sensitive material, zinc oxide photo-sensitive material, amorphous silicon photo-sensitive material, and the like.

Surrounding the photosensitive drum 1, there are equipped the charge roll 3 which is used for charging, the laser-light irradiation equipment 4 which is used for latent image formation, the developing roll 7 which is used for developing, the transfer roll 5 which is used for transfer, and the cleaning equipment 13. The above-mentioned equipment are placed around the photosensitive drum in the above-mentioned order which is the same with the direction of the drum rotation.

The charge roll 3 is for uniformly charging either positively or negatively the surface of the photosensitive drum. The charging of the surface of the photosensitive drum is carried out by imposing a voltage to the charge roll which is placed in contact with the photosensitive drum. The charge roll 3 can be optionally replaced by other charging method using corona-discharge.

The laser-light irradiation equipment 4 is for making a latent image in such a manner that the equipment irradiates the light with a pre-determined pattern corresponding to the image signal onto the surface of the photosensitive drum which is uniformly charged, thereby a latent image is formed in a portion to which the light is irradiated (in the case of reversal development), or in a portion to which the light is not irradiated (in the case of regular development). As other latent image forming equipment, there may be mentioned a combination of LED array with optical system.

The development roll 7 is for forming a visible image by making a toner adhere to the photosensitive drum 1 in such a manner that a bias voltage is imposed between the development roll and the photosensitive drum to make a toner adhere to a irradiated portion in the case of reversal development or a non-irradiated portion in the case of regular development.

The development roll 7 and the supply roll 9 are equipped inside of development equipment 11 in which the toner 10 is stored. The development roll is set closely to the photosensitive drum so that the development roll is partly in contact with the photosensitive drum. The development roll rotates to the direction B which is opposite direction to the direction of rotation of the photosensitive drum. The supply roll 9, which is in contact with the development roll, rotates to the same direction with the direction the development roll rotation, and supply the toner to the outer surface of the development roll. Generally, a voltage is also imposed on the supply roll to enhance smooth supply of the toner.

In the surrounding of the development roll, the blade for development roll 8, which is used for controlling thickness, is equipped in between the contact points with the supply roll and the photosensitive drum. Said blade for development roll is composed of conductive rubber or stainless steel. A voltage from 200 to 600 V in absolute value is imposed on the blade to inject a charge to the toner. Hence, an electric resistance of the blade for development roll is preferably 4 to 8th power of 10 (Ω·cm).

In the development equipment 11 in the image forming apparatus, the toner is stored as described-above.

The transfer roll 5 is used for transferring a toner image, which was made on the surface of the photosensitive drum by the development roll, to the transfer medium 6. As the transfer medium, there may be mentioned paper, OHP sheet, and the like. Besides the transfer roll, a corona-discharge equipment, a transfer belt, and the like may be optionally mentioned as a transfer method.

The toner image transferred to the transfer medium is fixed onto the transfer medium by using the fixing equipment 2. The fixing method is usually consists of a combination of heating method and sticking-by-pressure method. Toners which were transferred to the transfer medium are melted by heating using heating equipment, to be fixed onto the surface of transfer medium by using sticking-by-pressure method.

The cleaning equipment 13 is used for wiping off the residual toners remained on the surface of the photosensitive drum which were not transferred to the transfer medium. The cleaning equipment consists of, for example, cleaning blade and the like. This cleaning equipment is not always necessary when other system in which cleaning is conducted spontaneously with development by the development roll is used.

The image forming process(of the present invention can be applied to color toners. Color images can be formed using three colors, magenta, cyan, and yellow; or four colors, magenta, cyan, yellow, and black.

Examples

The present invention will hereinafter be described more specifically by the following examples and comparative examples. Such examples, however, are not to be construed as limiting in any way the scope of the present invention. All designations of "part" or "parts" and "%" as will be used in the following examples mean part or parts by weight and wt. % unless expressly noted.

Methods for evaluating physical properties in the following examples and comparative examples will hereinafter be described.

(1) Particle Size Distribution of Colloid $D_{50}$ (50% cumulative value of number particle diameter distribution) and $D_{90}$ (90% cumulative value of number particle diameter distribution) were measured by Particle Size Distribution Measuring Apparatus (trade name: SALD 2000A, manufactured by Shimazu Corporation) with the following conditions

| | |
|---|---|
| Refractive index: | 1.55-0.20j |
| Ultrasonic wave radiation time: | 5 minutes |
| Dispersion Medium: | a 10% aqueous salt solution |

(2) Particle Diameter of Toner:

The volume average particle diameter (dv) of a polymer particle and the particle diameter distribution(dv/dp), i.e., ratio of the volume average particle diameter (dv) to the number average particle diameter (dp), was measured by means of a Multisizer (manufactured by Beckman Coulter Inc.). The measurement by the Multisizer was conducted under the following conditions:

aperture diameter: 100 μm;

medium: Isothone II;

number of particles measured: 100,000 particles.

(3) Spheroidicity:

A scanning electron microphotograph of a toner sample was taken and photographs thus-obtained were read by Neksas 9000 image processing apparatus, and a ratio (rl/rs) of a length (rl) to a breadth (rs) thereof was calculated out about 100 particles per sample to calculate an average value thereof.

(4) Gel Content:

A toner (1 g) was precisely weighed and put into extraction thimble (cylindrical filter paper) (86R size 28×100 mm, manufactured by Advantec Ltd.) and subjected to extraction for a period of six hours using tetrahydrofuran as an extraction solvent which was charged into a lower flask of a Soxhlet extractor. After completion of the extraction, extraction solvent was recovered and resin solubilized in the solvent was separated and weighed precisely. The gel content was calculated as follows:

$$\text{gel content (\%)}=((T-S)/T)\times 100$$

T: toner sample (g)

S: resin solubilized in the solvent (g)

(5) Volume Resistivity:

The volume resistivity of each toner sample was measured by means of a dielectric loss measuring device (trade name :TRS-10 Model, manufactured by Ando Electric Co., Ltd.) under conditions of a temperature at 30° C. and a frequency of 1 kHz using specimens prepared by pressing a toner sample (about 3 g) placed in a tablet molding apparatus having a diameter of 5 cm by the weight of 100 Kg for one minute.

(6) Suction Blow Charge Level

Charge levels under environments of L/L (10° C. in temperature and 20% in relative humidity) and H/H (30° C. in temperature and 80% in relative humidity) were measured, and dependence and conditions of the toner by changes in environment were evaluated from the variations of charge level under the respective environments.

After a toner sample was placed into a printer of non-magnetic one-component type (trade name: Microline 12n, manufactured by Oki Electric Industry Co., Ltd. ) under above-described environments and left to stand overnight, a print patterns of half tone in black were printed 5 times. Then, printing was stopped during the course of direct printing. Thereafter, the toner on the developing roll was sucked into a suction type charge level-measuring meter to measure a charge level per unit weight based on the charge level and weight of the toner sucked.

(7) Blow-off Charge Level

Carrier TEFV-150/250 (57 g) and a toner (3 g) were placed into a ball-mill-pot having 100 $cm^3$ in volume and agitated/mixed for 30 minutes. The charge level per unit weight was measured by blow-off charge level-measuring meter (trade name: TB-200, manufactured by Toshiba Chemical Corporation)

(8) Dispersibility of Colorant 1:

To a portion of charge control resin composition for negative charge was added toluene which is capable of solubilizing therein the charge control resin for negative charge, thereby obtaining 5% solution of the charge control resin composition for negative charge. Thereafter, the solution was coated on a glass plate using a doctor blade having a thickness of 30 μm and dried to form a sheet. The number of colorant particles having a length of at least 0.2 μm in an area of 100 μm×100 μm of the toner sheet was counted by observing the sheet by optical micrograph.

(9) Dispersibility of Colorant 2:

An appropriate amount of a toner is placed on a slide-glass and a cover-glass is placed on top of the thus-placed toner. They were heated to 170° C. by using a hot-plate, thereby the toner was melted. Then, the melted toner was pressed by pressing the cover-glass to adjust thickness of the toner to 20 μm as observed by thickness meter (trade name: K-402B, manufactured by Anritsu Corporation). The number of colorant particles having a length of at least 0.2 μm in an area of 100 μm×100 μm of the toner sheet was counted using a portion of the toner sheet having a thickness of 20 μm.

(10) Evaluation of Image Quality:

Using a printer of non-magnetic one-component type (trade name: Microline 12n, manufactured by Oki Electric Industry Co., Ltd.), direct printings were conducted for each color. Color tone was measured by spectral color difference meter (trade name: SE2000; manufactured by Nippon Denshoku Co.). The higher absolute number obtained by the measurement indicates the brighter or clearer colorfulness image density of the direct printings was measured by using a color-reflection densitometer (trade name: 404A, manufactured by X-light Co.). Fogs at an unprinted area were measured by CM-1000(trade name) manufactured by Minolta Camera Co., Ltd.

Example 1

(1) Synthesis of Charge Control Resin Composition for Negative Charge (A1)

To 100 parts of a charge control resin for negative charge (weight average molecular weight (Mw): 10,000, glass transition temperature: 65° C.) which was obtained by polymerizing monomer mixture composing of 82% of styrene, 11% of butyl acrylate and 7% of 2-acrylamide-2-methylpropanesufonic acid, were added and dispersed 24 parts of toluene and 6 parts of methanol, and they were mixed by roll under chilling.

After the thus-obtained mixture was adhered (stuck) to the roll, 100 parts by weight of a magenta colorant (C.I. Pigment Red 184 manufactured by Clariant Co., Ltd.) was gradually added, and they were mixed for a period of one hour, leading to manufacture of the charge control resin composition for negative charge (A1), wherein initial width between rolls of 1 mm was gradually widened to final width of 3 mm, and organic solvent (mixed solvent of toluene/methanol=4/1) were additionally added depending on mixing operation of the charge control resin for negative charge.

To a portion of the charge control resin composition for negative charge (A1) thus-obtained was added toluene to obtain 5% toluene solution of the charge control resin composition for negative charge (A1). Then, the thus-obtained solution was coated on a glass plate using a doctor blade having a thickness of 20 μm and dried. No particle having a length of at least 0.2 μm in an area of 100 μm×100 μm of the sheet was counted by observing the sheet by optical micrograph.

(2) Preparation of Colloid Solution

An aqueous solution containing 6.9 parts of sodium hydroxide (alkali metal hydroxide) dissolved in 50 parts of ion-exchange water (i.e., water which had been subjected to ion exchange) was gradually added to an aqueous solution containing 9.8 parts of magnesium chloride (water-soluble polyvalent metal salt) dissolved in 250 parts of ion-exchange water, under stirring to prepare a magnesium hydroxide colloid (hardly water-soluble metal hydroxide colloid) dispersion. The particle size distribution of the colloid thus obtained was measured and found out to be 0.38 μm in terms of $D_{50}$ (50% cumulative value of number particle diameter distribution) and 0.82 μm in terms of $D_{90}$ (90% cumulative value of number particle diameter distribution).

(3) Monomer Composition for Core

A polymerizable monomer composition for core consisting of 80.5 parts of styrene and 19.5 parts of butyl acrylate was mixed and agitated with 12 parts of charge control resin composition for negative charge (A1), 3 parts of TDM, and 10 parts of pentaerythritol-tetrastearate to obtain a uniformly dispersed monomer composition for core.

(4) Monomer Composition for Shell 2 parts of Methyl methacrylate and 100 parts of water are subjected to micro-dispersion treatment using ultrasonic-emulsifier to obtain an aqueous dispersion of monomer for shell. The particle diameter distribution of a droplet of the aqueous dispersion of monomer for shell was measured by means of a particle diameter distribution measuring apparatus (trade name: SALD 2000A, manufactured by Shimazu Corporation ) and found to be 1.6 μm in terms of $D_{90}$.

(5) Polymerization of Capsule Toner

The above-obtained monomer composition for core was poured into the above-described colloidal dispersion of magnesium hydroxide, the mixture was stirred until droplets became stable, and then 6 parts of t-butyl peroxy-2-ethylhexanoate (trade name: Perbutyl O, manufactured by NOF Corporation) was added as a polymerization initiator. The resultant monomer mixture was stirred 30 minutes at 15,000 rpm under high shearing force by means of an Ebara Milder to form fine droplets of the monomer mixture. The thus-prepared aqueous dispersion containing droplets of the monomer mixture for core was poured into a reactor equipped with an agitating blade to initiate a polymerization reaction at 90° C. At the time the conversion of the monomer into a polymer reached almost 100%, sampling was conducted to measure the particle diameter of the core particles formed. As a result, the particle diameter of the core particles was found to be 7.2 μm. The above-described aqueous dispersion of the polymerizable monomer for shell and an aqueous solution of 0.2 parts of polymerization initiator [2,2'-azobis(2-methyl-N-(2-hydroxyethyl)-propionamide)] (trade name: VA-086, manufactured by Wako Pure Chemical Industries, Ltd.) dissolved in 65 parts of distilled water were added to the reactor. After the polymerization reaction was continued for 8 hours, the reaction was stopped, thereby obtaining an aqueous dispersion of toner particles having a pH of 9.5.

While stirring the aqueous dispersion of toner particles obtained above, the pH thereof was adjusted to be at most 5 by sulfuric acid, and the dispersion was rinsed with acid (at 25° C. for 10 minutes). Thus-rinsed dispersion was then filtered and dehydrated. Then, 500 parts of ion-exchange water was newly added to form a slurry again to conduct rinsing with water. Then, dehydration-rinsing with water steps were repeated several times. Thereafter, solid residue was separated by filtration and dried over 2 days and nights by a dryer at 45° C., and toner particles were obtained.

The dried toner particles were taken out for measurement. The results were that volume average particle diameter (dv) was 7.2 μm, volume average particle diameter (dv)/number average particle diameter (dp) was 1.24, rl/rs was 1.1, and gel content was 0%. And, the number of colorant particle having a length of at least 0.2 μm remaining in the unit area was zero.

To 100 parts of the toner particles obtained above was added 0.6 parts of colloidal silica (trade name: RX-200, manufactured by Nihon Aerosil Co.) subjected to a hydrophobicity-imparting treatment, and they were mixed by means of a Henschel mixer to prepare a negatively charged toner. The volume resistivity of the thus obtained toner was measured and found out to be 12.0(log(Ωcm)). The results of evaluation of toner properties and images are shown in Table 1.

Example 2

A toner was obtained in the same manner as in Example 1 except that the C.I. Pigment Red 184 was replaced by cyan pigment (trade name: C.I. Pigment Blue 15:3, manufactured by Clariant Co., Ltd.). The results of evaluation of toner properties and images are shown in Table 1.

Example 3

A toner was obtained in the same manner as in Example 1 except that the C.I. Pigment Red 184 was replaced by yellow pigment (trade name: C.I. Pigment Yellow 180, manufactured by Clariant Co., Ltd.). The results of evaluation of toner properties and images are shown in Table 1.

Example 4

A toner was obtained in the same manner as in Example 1 except that a charge control resin composition for negative charge prepared by heat-melting (A2) was used instead of using a solvent for mixing the charge control resin for negative charge and colorants. The results of evaluation of toner properties and images are shown in Table 1.

COMPARATIVE EXAMPLE 1

A charge control resin composition for negative charge was obtained in the same manner as in Example 1 except that 100 parts of the charge control resin for negative charge used in Example 1 was replaced by 100 parts by weight of a binder resin consisting of 84% of styrene and 16% of butyl acrylate (weight average molecular weight: 13,000, glass transition temperature: 64° C.). A polymerizable monomer composition for core was obtained in the same manner as in Example 1 except that 12 parts of charge control resin composition for negative charge (A1) used in Example 1 was replaced by a combination of 12 parts of the above-described binder resin composition and 6 parts of charge control resin composition for negative charge (A1). Thus-obtained polymerizable monomer composition for core was used to obtain a magenta toner in the same manner as in Example 1. The results of evaluation of toner properties and images are shown in Table 1.

COMPARATIVE EXAMPLE 2

A magenta toner was obtained in the same manner as in Example 1 except that the process until monomer composition for core was obtained was replaced by the following process. To 20 parts of the charge control resin for negative charge were added 80 parts of styrene as solvent and 20 parts of magenta pigment (trade name: C.I. Pigment Red 184, manufactured by Clariant Co., Ltd.), and they were mixed. Thereafter, the mixture solution was dispersed by using an overflow-type horizontal, cylindrical media-type dispersing device which was previously filled with steel beads as media having a diameter of 1.5 mm and a density of 7.4 g/cm$^3$ at a filling rate of 75 volume % under conditions that a tip speed of a stirring body of the media-type dispersing device was about 9 m/s, a holding time of the mixture was 0.1 hour, an apparent linear velocity in the dispersing device of the mixture passing through the dispersing device was 0.16 m/min and a temperature in the dispersing device was about 35° C., thereby a viscous charge control resin composition for negative charge (C1) was obtained.

To a portion of the thus-obtained charge control resin composition for negative charge (C1) was added toluene, thereby obtaining 5% solution of the charge control resin composition for positive charge in toluene and styrene. Thereafter, the solution was coated on a glass plate using a doctor blade having a thickness of 30 μm and dried to form a sheet. The number of colorant particles having a length of at least 0.2 μm in an area of 100 μm×100 μm of the sheet counted by observing the sheet by optical micrograph was 89. Then, 36 parts of the above-described monomer composition (6 parts of charge control resin for negative charge+6 parts of pigment+24 parts of styrene), 56.5 parts of styrene, 19.5 parts of butyl acrylate, 3 parts of TDM and 10 parts of pentaerythritol-tetrastearate were agitated and mixed, thereby obtaining a monomer composition for core. The results of evaluation of toner properties and images are shown in Table 1.

TABLE 1

| | | Example | | | | Comparative Example | |
|---|---|---|---|---|---|---|---|
| | | 1 | 2 | 3 | 4 | 1 | 2 |
| Pigment (parts) | | 100 | 100 | 100 | 100 | 100 | 20 |
| Charge control resin (parts) | | 100 | 100 | 100 | 100 | — | 20 |
| Resin (parts) | | — | — | — | — | 100 | — |
| Weight average molecular weight | | 10000 | 10000 | 10000 | 10000 | 13000 | 10000 |
| Glass transition temperature (° C.) | | 65 | 65 | 65 | 65 | 64 | 65 |
| Organic solvent (parts) | | 30 | 30 | 30 | 0 | 30 | 80 |
| Roll kneading temperature (° C.) | | 25 | 25 | 25 | 100 | 25 | — |
| Dispersibility of colorant 1 (numer of particles) | | 0 | 0 | 0 | 2 | 26 | 89 |
| Propeties of Toner | | | | | | | |
| d v (μm) | | 7.2 | 7.1 | 7.3 | 7.2 | 7.1 | 7.8 |
| d v/d p | | 1.24 | 1.25 | 1.28 | 1.24 | 1.26 | 1.38 |
| Spheroidicity (r l/r s) | | 1.1 | 1.1 | 1.1 | 1.1 | 1.2 | 1.3 |
| Volume resistivity (l o g (Ω · cm) ) | | 12.2 | 12.0 | 12.2 | 11.8 | 11.4 | 11.2 |
| Suction blow charge level L/L (μC/g) | | −26 | −24 | −28 | −18 | −14 | −12 |
| Suction blow charge level H/H (μC/g) | | −21 | −21 | −25 | −15 | −10 | −9 |
| Dispersibility of colorant 2 (numer of particles) | | 2 | 4 | 3 | 26 | 156 | more than 500 |
| Image quality | | | | | | | |
| Color tone | L* | +62.3 | +62.8 | +91.4 | +60.6 | +56.4 | +54.2 |
| | a* | +68.5 | −35.1 | −19.2 | +64.3 | +60.2 | +57.8 |
| | b* | −34.2 | −46.2 | +78.9 | −31.2 | −28.8 | −26.4 |
| Printing density | 1.49 | 1.45 | 1.46 | 1.38 | 1.2 | 1.12 | |
| Fog | 0.3 | 0.4 | 0.4 | 0.8 | 2.6 | 4.4 | |

From the results in Table 1, it is understood that the toners for negative charge in the comparative example 1 and 2, in which numbers of colorant particles having a length of 0.2 μm or more counted in a unit area are larger than that of specified in the present invention, have poor spectral properties including low transparency, high generation of fogs, and low printing density.

On the other hand, it is understood that a negatively charged color toner according to the present invention has excellent spectral properties including high transparency needed for reproduction of a clear color tone in color images, low generation of fogs, and is capable of increasing print density.

Example 5

(1) Synthesis of Charge Control Resin Composition for Positive Charge (B1)

To 100 parts of a charge control resin for positive charge (weight average molecular weight (Mw): 12,000, glass transition temperature: 67° C.) which was obtained by polymerizing monomer mixture composing of 82% of styrene, 11% of butyl acrylate and 7% of dimethylaminoethylbenzylchloro methacrylate, were added and dispersed 24 parts of toluene and 6 parts of methanol, and they were mixed by roll under chilling. After the thus-obtained mixture was adhered (stuck) to the roll, 100 parts by weight of a magenta colorant (C.I. Pigment Red 184, manufactured by Clariant Co., Ltd.) was gradually added, and they were mixed for a period of one hour, leading to manufacture of the charge control resin composition for positive charge (B1), wherein initial width between rolls of 1 mm was gradually widened to final width of 3 mm, and organic solvent (mixed solvent of toluene/methanol=4/1) were additionally added depending on mixing operation of the charge control resin for positive charge.

To a portion of the charge control resin composition for positive charge (B1) was added toluene, thereby obtaining 5% toluene solution of the charge control resin composition for positive charge (B1). Then, the thus-obtained solution was coated on a glass plate using a doctor blade having a thickness of 30 μm and dried. No particle having a length of at least 0.2 μm in an area of 100 μm×100 μm of the sheet was counted by observing the sheet by optical micrograph.

(2) Preparation of Colloid Solution

An aqueous solution containing 6.9 parts of sodium hydroxide (alkali metal hydroxide) dissolved in 50 parts of ion-exchange water (i.e., water which had been subjected to ion exchange) was gradually added to an aqueous solution containing 9.8 parts of magnesium chloride (water-soluble polyvalent metal salt) dissolved in 250 parts of ion-exchange water, under stirring to prepare a magnesium hydroxide colloid (hardly water-soluble metal hydroxide colloid) dispersion. The particle size distribution of the colloid thus obtained was measured and found out to be 0.38 μm in terms of $D_{50}$ (50% cumulative value of number particle diameter distribution) and 0.82 μm in terms of $D_{90}$ (90% cumulative value of number particle diameter distribution).

(3) Monomer Composition for Core

A polymerizable monomer composition for core consisting of 80.5 parts of styrene and 19.5 parts of butyl acrylate was mixed and agitated with 12 parts of the charge control resin composition for positive charge (B1), 3 parts of TDM, and 10 parts of pentaerythritol-tetrastearate to obtain a uniformly dispersed monomer composition for core.

(4) Monomer Composition for Shell 2 parts of Methyl methacrylate and 100 parts of water are subjected to micro-dispersion treatment using ultrasonic-emulsifier to obtain an aqueous dispersion of monomer for shell. The particle diameter distribution of a droplet of the aqueous dispersion of monomer for shell was measured by means of a particle diameter distribution measuring apparatus (trade name: SALD 2000A, manufactured by Shimazu Corporation) and found to be 1.6 μm in terms of $D_{90}$.

(5) Polymerization of Capsule Toner

The above-described monomer composition for core was poured into the above-described colloidal dispersion of magnesium hydroxide, the mixture was stirred until droplets became stable, and then 6 parts of t-butyl peroxy-2-ethylhexanoate (trade name: Perbutyl O, manufactured by NOF Corporation) was added as a polymerization initiator. The resultant monomer mixture was stirred 30 minutes at 15,000 rpm under high shearing force by means of an Ebara Milder to form fine droplets of the monomer mixture. The thus-prepared aqueous dispersion containing droplets of the monomer mixture for core was poured into a reactor equipped with an agitating blade to initiate a polymerization reaction at 90° C. At the time the conversion of the monomer into a polymer reached almost 100%, sampling was conducted to measure the particle diameter of the core particles formed. As a result, the particle diameter of the core particles was found to be 7.4 μm. The above-described aqueous dispersion of the polymerizable monomer for shell and an aqueous solution of 0.2 parts of polymerization initiator [2,2'-azobis(2-methyl-N-(2-hydroxyethyl)-propionamide)] (trade name: VA-086, manufactured by Wako Pure Chemical Industries Ltd.) dissolved in 65 parts of distilled water were added to the reactor. After the polymerization reaction was continued for 8 hours, the reaction was stopped, thereby obtaining an aqueous dispersion of toner particles having a pH of 9.5.

While stirring the aqueous dispersion of toner particles obtained above, the pH thereof was adjusted to be at most 5 by sulfuric acid, and the dispersion was rinsed with acid (at 25° C. for 10 minutes). Thus-rinsed dispersion was then filtered and dehydrated. Then, 500 parts of ion-exchange water was newly added to form a slurry again to conduct rinsing with water. Then, dehydration-rinsing with water steps were repeated several times. Thereafter, solid residue was separated by filtration and dried over 2 days and nights by a dryer at 45° C., and toner particles were obtained.

The dried toner particles were taken out for measurement. The results were that volume average particle diameter (dv) was 7.4 μm, volume average particle diameter (dv)/number average particle diameter (dp) was 1.23, rl/rs was 1.1, and gel content was 0%. And, the number of pigment particle remaining in the unit area was zero. To 100 parts of the toner particles obtained above was added 0.6 parts of colloidal silica (trade name: RX-200, manufactured by Nihon Aerosil Co.) subjected to a hydrophobicity-imparting treatment, and they were mixed by means of a Henschel mixer to prepare a positively charged toner. The volume resistivity of the thus obtained toner was measured and found out to be 12.0(log (Ωcm)). The results of evaluation of toner properties and images are shown in Table 2.

Example 6

A toner was obtained in the same manner as in Example 5 except that the C.I. Pigment Red 184 was replaced by cyan pigment (trade name: C.I. Pigment Blue 15:3, manufactured by Clariant Co., Ltd.). The results of evaluation of toner properties and images are shown in Table 2.

Example 7

A toner was obtained in the same manner as in Example 5 except that the C.I. Pigment Red 184 was replaced by yellow pigment (trade name: C.I. Pigment Yellow 180, manufactured by Clariant Co., Ltd.). The results of evaluation of toner properties and images are shown in Table 2.

Example 8

A toner was obtained in the same manner as in Example 5 except that the charge control resin composition for positive charge prepared by heat-melting (B2) was used instead of using a solvent for mixing the charge control resin for positive charge and colorants. The results of evaluation of toner properties and images are shown in Table 2.

COMPARATIVE EXAMPLE 3

A charge control resin for positive charge was obtained in the same manner as in Example 5 except that 100 parts of the charge control resin for positive charge used in Example 5 was replaced by 100 parts by weight of a binder resin consisting of 84% of styrene and 16% of butyl acrylate (weight average molecular weight: 14,000, glass transition temperature: 64° C.). A polymerizable monomer composition for core was obtained in the same manner as in Example 5 except that 12 parts of charge control resin composition for positive charge (B1) used in Example 5 was replaced by a combination of 12 parts of the above-described binder resin composition and 6 parts of charge control resin composition for positive charge (B1). Thus-obtained polymerizable monomer composition for core was used to obtain a magenta toner in the same manner as in Example 5. The results of evaluation of toner properties and images are shown in Table 2.

COMPARATIVE EXAMPLE 4

A magenta toner was obtained in the same manner as in Example 5 except that the process until monomer composition for core was obtained was replaced by the following process. To 20 parts of the charge control resin for positive charge were added 80 parts of styrene as solvent and 20 parts of magenta pigment (trade name: C.I. Pigment Red 184, manufactured by Clariant Co., Ltd.), and they were mixed. Thereafter, the mixture solution was dispersed by using an overflow-type horizontal, cylindrical media-type dispersing device which was previously filled with steel beads as media having a diameter of 1.5 mm and a density of 7.4 g/cm$^3$ at a filling rate of 75 volume % under conditions that a tip speed of a stirring body of the media-type dispersing device was about 9 m/s, a holding time of the mixture was 0.1 hour, an apparent linear velocity in the dispersing device of the mixture passing through the dispersing device was 0.16 m/min and a temperature in the dispersing device was about 35° C., thereby a viscous charge control resin composition for positive charge (D1) was obtained.

To a portion of the thus-obtained charge control resin composition for positive charge (D1) was added toluene, thereby obtaining 5% solution of the charge control resin composition for positive charge in toluene and styrene. Thereafter, the solution was coated on a glass plate using a doctor blade having a thickness of 30 μm and dried to form a sheet. The number of colorant particles having a length of at least 0.2 μm in an area of 100 μm×100 μm of the sheet counted by observing the sheet by optical micrograph was 126.

Then, 36 parts of the above-described monomer composition (6 parts of charge control resin for positive charge+6 parts of pigment+24 parts of styrene), 56.5 parts of styrene, 19.5 parts of butyl acrylate, 3 parts of TDM and 10 parts of pentaerythritol-tetrastearate were agitated and mixed to obtain a monomer composition for core. The results of evaluation of toner properties and images are shown in Table 2.

TABLE 2

| | | Example | | | | Comparative Example | |
|---|---|---|---|---|---|---|---|
| | | 5 | 6 | 7 | 8 | 3 | 4 |
| Pigment (parts) | | 100 | 100 | 100 | 100 | 100 | 20 |
| Charge control resin (parts) | | 100 | 100 | 100 | 100 | — | 20 |
| Resin (parts) | | — | — | — | — | 100 | — |
| Weight average molecular weight | | 12000 | 12000 | 12000 | 12000 | 14000 | 12000 |
| Glass transition temperature (° C.) | | 67 | 67 | 67 | 67 | 64 | 67 |
| Organic solvent (parts) | | 30 | 30 | 30 | 0 | 30 | 80 |
| Roll kneading temperature (° C.) | | 25 | 25 | 25 | 100 | 25 | — |
| Dispersibility of colorant 1 (numer of particles) | | 0 | 0 | 0 | 3 | 38 | 126 |
| Propeties of Toner | | | | | | | |
| d v (μm) | | 7.4 | 7.1 | 7.3 | 7.2 | 7.1 | 7.2 |
| d v/d p | | 1.23 | 1.25 | 1.28 | 1.24 | 1.26 | 1.24 |
| Spheroidicity (r l/r s) | | 1.1 | 1.1 | 1.1 | 1.1 | 1.2 | 1.1 |
| Volume resistivity (l o g (Ω · cm) ) | | 12 | 12 | 12.1 | 11.8 | 11.4 | 11.2 |
| Suction blow charge level L/L (μC/g) | | +26 | +23 | +27 | +13 | +18 | +13 |
| Suction blow charge level H/H (μC/g) | | +23 | +21 | +24 | +10 | +14 | +10 |
| Dispersibility of colorant 2 (numer of particles) | | 3 | 6 | 4 | 18 | 210 | more than 500 |
| Image quality | | | | | | | |
| Color tone | L* | +61.2 | +62.2 | +91.1 | +59.4 | +54.2 | +52.6 |
| | a* | +67.6 | −34.5 | −19.0 | +65.3 | +58.6 | +55.3 |
| | b* | −33.6 | −45.8 | +78.6 | −30.3 | −27.3 | −25.5 |
| Printing density | 1.48 | 1.43 | 1.44 | 1.36 | 1.14 | 1.06 | |
| Fog | 0.4 | 0.5 | 0.4 | 0.9 | 3.6 | 5.8 | |

From the results in Table 2, it is understood that the toners for positive charge in the comparative example 3 and 4, in which numbers of colorant particles having a length of 0.2 μm or more counted in a unit area are larger than that of specified in the present invention, have poor spectral properties including low transparency, high generation of fogs, and low printing density.

On the other hand, it is understood that a positively charged color toner according to the present invention has excellent spectral properties including high transparency needed for reproduction of a clear color tone in color images, low generation of fogs, and is capable of increasing print density.

Example 9

(1) Synthesis of Charge Control Resin Composition for Negative Charge

To 100 parts of a charge control resin for negative charge (weight average molecular weight (Mw): 20,000, glass transition temperature: 65° C.) which was obtained by polymerizing monomer mixture composing of 82% of styrene, 11% of butyl acrylate and 7% of 2-acrylamide-2-methylpropanesufonic acid, were added and dispersed 24 parts of methyl ethyl ketone and 6 parts of methanol, and they were mixed by roll under chilling.

After the thus-obtained mixture was adhered (stuck) to the roll, 100 parts of a magenta colorant (C.I. Pigment Red 122 manufactured by Clariant Co., Ltd.) was gradually added, and they were mixed for a period of one hour, leading to manufacture of the charge control resin composition for negative charge (A3), wherein initial width between rolls of 1 mm was gradually widened to final width of 3 mm, and organic solvent (mixed solvent of toluene/methanol=4/1) were additionally added several times depending on mixing operation of the charge control resin for negative charge.

To a portion of the charge control resin composition for negative charge (A3) thus-obtained was added toluene to obtain 5% toluene solution of the charge control resin composition for negative charge (A3). Then, the thus-obtained solution was coated on a glass plate using a doctor blade having a thickness of 30 μm and dried. No particle having a length of at least 0.2 μm in an area of 100 μm×100 μm of the sheet was counted by observing the sheet by optical micrograph.

(2) Synthesis of Charge Control Resin Composition for Positive Charge

To 100 parts of a charge control resin for positive charge (weight average molecular weight (Mw): 12,000, glass transition temperature: 67° C.) which was obtained by polymerizing monomer mixture composing of 83% of styrene, 15% of butyl acrylate and 2% of N,N-diethyl-N-methyl-2-(methacryloyloxy) ethyl ammonium p-toluene sulfonic acid, were added and dispersed 24 parts of methyl ethyl ketone and 6 parts of methanol, and they were mixed by roll under chilling. After the thus-obtained mixture was adhered (stuck) to the roll, 100 parts by weight of a magenta colorant (C.I. Pigment Red 122, manufactured by Clariant Co., Ltd.) was gradually added, and they were mixed for a period of one hour, leading to manufacture of the charge control resin composition for positive charge (B3), wherein initial width between rolls of 1 mm was gradually widened to final width of 3 mm, and organic solvent (mixed solvent of toluene/methanol=4/1) were additionally added several times depending on mixing operation of the charge control resin for positive charge.

To a portion of the charge control resin composition for positive charge(B3) was added toluene, thereby obtaining 5% toluene solution of the charge control resin composition for positive charge (B3). Then, the thus-obtained solution was coated on a glass plate using a doctor blade having a thickness of 30 μm and dried. No particle having a length of at least 0.2 μm in an area of 100 μm×100 μm of the sheet was counted by observing the sheet by optical micrograph.

A polymerizable monomer composition for core consisting of 80.5 parts of styrene and 19.5 parts of butyl acrylate was mixed and agitated with 3.5 parts of the charge control resin composition for negative charge (A3), 8.5 parts of the charge control resin composition for positive charge (B3), 3 parts of TDM and 10 parts of pentaerythritol-tetrastearate to obtain a uniformly dispersed monomer composition for core.

An aqueous solution containing 6.9 parts of sodium hydroxide (alkali metal hydroxide) dissolved in 50 parts of ion-exchange water (i.e., water which had been subjected to ion exchange) was gradually added to an aqueous solution containing 9.8 parts of magnesium chloride (water-soluble polyvalent metal salt) dissolved in 250 parts of ion-exchange water, under stirring to prepare a magnesium hydroxide colloid (hardly water-soluble metal hydroxide colloid) dispersion. The particle size distribution of the colloid thus obtained was measured and found out to be 0.38 μm in terms of $D_{50}$ (50% cumulative value of number particle diameter distribution) and 0.82 μm in terms of $D_{90}$ (90% cumulative value of number particle diameter distribution).

The above-described monomer composition for core and 5 parts of t-butyl peroxy-2-ethylhexanoate (polymerization initiator) were poured into the above-described colloidal dispersion of magnesium hydroxide. The mixture was stirred and mixed using propeller-type agitator to obtain aqueous dispersion of the composition. Then, by using a pump, the aqueous dispersion is fed to granulation apparatus (Clearmix CLM-0.8s, manufactured by M Technique Co.) whose rotator is rotating as 21,000 rpm, thereby to obtain a droplet (granule) of the polymerizable monomer composition for core.

The thus-obtained aqueous dispersion containing droplets of the polymerizable monomer composition was poured into a reactor equipped with an agitating blade to initiate polymerization. The temperature of the aqueous dispersion was maintained at 90° C. by controlling the jacket-temperature using cascade-control method by means of measuring the temperature of the jacket of polymerization-vessel and the temperature of the aqueous dispersion under polymerization.

At the time when conversion of the monomer into a polymer reached almost 100%, sampling was conducted to measure the particle diameter of the core particles formed. As a result, the particle diameter of the core particles was found to be 7.3 μm.

Thereafter, 2 parts of methyl methacrylate and an aqueous solution of 0.2 parts of polymerization initiator [2,2'-azobis (2-methyl-N-(2-hydroxyethyl)-propionamide)](trade name: VA-086, manufactured by Wako Pure Chemical Industries, Ltd.) dissolved in 100 parts of distilled water were added to the reactor. After the polymerization reaction was continued for 8 hours, the reaction was stopped, thereby obtaining an aqueous dispersion of toner particles having a pH of 9.5.

While stirring the aqueous dispersion of toner particles thus-obtained, the pH thereof was adjusted to be at most 5 by sulfuric acid, and the dispersion was rinsed with acid (at 25° C. for 10 minutes). Thus-rinsed dispersion was then filtered and dehydrated. Then, 500 parts of ion-exchange water was newly added to form a slurry again to conduct rinsing with water. Then, dehydration-rinsing with water steps were repeated several times. Thereafter, solid residue was separated by filtration and dried over 2 days and nights by a dryer at 45° C., and toner particles were obtained.

The dried toner particles were taken out for measurement. The results were that volume average particle diameter (dv) was 7.3 μm, volume average particle diameter (dv)/number average particle diameter (dp) was 1.21, and rl/rs was 1.1. And, the number of pigment particle remaining in the unit area was one.

To 100 parts of the polymer particles obtained above was added 0.6 part of colloidal silica (trade name: RX-200, manufactured by Nihon Aerosil Co.) subjected to a hydrophobicity-imparting treatment, and they were mixed by means of a Henschel mixer to prepare a toner. The results of evaluation of toner properties and image qualities are shown in Table 3.

TABLE 3

| | | Example 9 |
|---|---|---|
| Propeties of Toner | | |
| d v (μm) | | 7.3 |
| d v/d p | | 1.21 |
| Spheroidicity (r l/r s) | | 1.1 |
| Volume resistivity (l o g Ω · C) | | 11.4 |
| Suction blow charge level L/L (μC/g) | | −63 |
| Suction blow charge level H/H (μC/g) | | −48 |
| Blow-off charge level | | −78 |
| Dispersibility of colorant 2 (numer of particles) | | 1 |
| Image quality | | |
| Color tone | L* | +62.1 |
| | a* | +68.3 |
| | b* | −34.3 |
| Printing density | 1.48 | |
| Fog | 0.4 | |

From the results in Table 3, it is understood that the toner in the Example 9 of the present invention is little in variation of charge levels by changes in environments, has excellent spectral properties including high transparency needed for reproduction of a clear color tone in color images and low generation of fogs, and is capable of increasing print density.

INDUSTRIAL APPLICABILITY

According to the present invention, there is provided a toner which is capable of uniformly dispersing a pigment therein and can provide a clear image in electrophotographic images and little in variation of charge levels by changes in environments, a production process thereof, and a process for forming images using said toner. In particular, for a color toner application, there is provided, a toner which is excellent in spectral properties including high transparency needed for reproduction of a clear color tone in color images, generates a fog to a small extent, is capable of increasing print density, and is further excellent in transferability, a production process thereof, and a process for forming images using said toner.

The invention claimed is:

1. A toner comprising a binder resin, a colorant and a charge control resin for positive and/or negative charge, wherein the number of colorant particles having a length of at least 0.2 μm in area of 100μm×100 μm of a toner sheet having a thickness of 20 μm is at most 50 wherein the toner sheet is obtained by placing the toner on a slide-glass, placing a cover-glass on top of the thus-placed toner, heating them to 170° C. by using a hot-plate to melt the toner, and pressing the cover-glass to adjust a thickness of the melted toner to 20 μm as observed by a thickness meter, and, wherein the charge control resin for positive and/or negative charge are/is a polymer having a substitution group containing monovinyl monomer unit.

2. The toner according to claim 1, wherein the toner is negative chargeable.

3. The toner according to claim 1, wherein the toner is positive chargeable.

4. The toner according to claim 2, wherein a blow-off charge level is in the range from minus 40 to minus 120 μC/g.

5. The toner according to claim 3, wherein a blow-off charge level is in the range from plus 20 to plus 100 μC/g.

6. The toner according to claim 1, wherein a volume resistivity is in the range from 10 to 13 (log (Ω·cm)).

7. The toner according to claim 1, which has a volume average particle diameter (dv) of 2 to 10 μm, a ratio (dv/dp) of a volume average particle diameter (dv) to a number average particle diameter (dp) of at most 1.7, and a ratio (rl/rs) of a length (rl) to a breadth (rs) of 1.0 to 1.2.

8. The toner according to claim 1, wherein Pigment Yellow 180 as a yellow colorant, Pigment Red 122 as a magenta colorant, and Pigment Blue 15:4 as a cyan colorant are used to obtain a full color toner.

9. The toner according to claim 1, wherein the charge control resin for negative charge is a polymer whose side-chain has a sulfonic acid group or a sulfonate group.

10. The toner according to claim 1, wherein the charge control resin for positive charge is a polymer whose side-chain has an amino group or an ammonium salt group.

11. A process for forming images which comprises the steps of:

recording an electrostatic latent image on a surface of photosensitive member, adhering the toner according to claim 1 on the surface of a photosensitive member to make the electrostatic latent image develop into a visible image, and transferring the visible image to a transfer medium.

12. The toner according to claim 1, wherein the toner is 1.0 to 1.2 in a ratio(rl/rs) of a length (rl) to a breadth (rs) thereof.

13. The toner according to claim 1, wherein the side-chain in the charge control resin for negative charge has at least one substitution group selected from the consisting of carboxylic group, carboxylate group, phenol group or its salt, thiophenol group or its salt, sulfonic acid group, and a sulfonate group, and wherein the side-chain in the charge control resin for positive charge has at least one substitution group selected from the group consisting of an amino group and an ammonium salt group.

14. The toner according to claim 1, wherein the side-chain in the charge control resin for negative charge has at least one substitution group selected from the group consisting of sulfonic acid group, and a sulfonate group, and wherein the side-chain in the charge control resin for positive charge has at least one substitution group selected from the group consisting of an amino group and an ammonium salt group.

15. The toner according to claim 14, wherein the amount of the substitution group containing monovinyl monomer unit in the charge control resin is 0.5 to 15% by weight.

16. The toner according to claim 1, which has a gel content of at most 80% by weight.

17. The toner according to claim 1, wherein the charge control resin for negative charge has a glass transition temperature of 40 to 80° C.

18. The toner according to claim 1, wherein the charge control resin for positive charge has a glass transition temperature of 40 to 100° C.

19. The toner according to claim 1 further comprising a poly-functional ester compound as a parting agent.

* * * * *